United States Patent [19]

Kessler et al.

[11] 4,396,366

[45] Aug. 2, 1983

[54] DEVICE FOR THE PRODUCTION OF A MULTICOMPONENT YARN COMPOSED OF AT LEAST TWO SYNTHETIC POLYMER COMPONENTS

[75] Inventors: Erich Kessler, Hochst; Peter Birken, Miltenberg, both of Fed. Rep. of Germany

[73] Assignee: Akzona Incorporated, Asheville, N.C.

[21] Appl. No.: 419,890

[22] Filed: Sep. 20, 1982

Related U.S. Application Data

[62] Division of Ser. No. 180,786, Aug. 25, 1980.

[30] Foreign Application Priority Data

Jan. 25, 1978 [DE] Fed. Rep. of Germany ... 7802110[U]
Jan. 25, 1978 [DE] Fed. Rep. of Germany ..... 2803136

[51] Int. Cl.[3] ..... A21C 3/00
[52] U.S. Cl. ..... 425/131.5; 425/467
[58] Field of Search ..... 264/171, 147; 425/131.5, 467

[56] References Cited

U.S. PATENT DOCUMENTS

| | | | |
|---|---|---|---|
| 2,464,301 | 3/1949 | Francis | 428/167 |
| 2,508,462 | 5/1950 | Marshall | 264/12 |
| 2,856,638 | 10/1958 | Schulken et al. | 264/210.4 |
| 2,987,797 | 6/1961 | Breen | 428/370 |
| 2,999,788 | 9/1961 | Morgan | 162/146 |
| 3,016,599 | 1/1962 | Perry | 28/78 |
| 3,062,702 | 11/1962 | Parrish, nee Guanidique R | 162/157 |
| 3,099,067 | 7/1963 | Merriam et al. | 28/82 |
| 3,117,906 | 1/1964 | Tanner | 428/397 |
| 3,195,865 | 7/1965 | Harder | 366/337 |
| 3,286,992 | 11/1966 | Armeniades et al. | 366/339 |
| 3,350,488 | 10/1967 | Breen | 264/171 |
| 3,382,305 | 5/1968 | Breen | 264/171 |
| 3,418,200 | 12/1968 | Tanner | 428/373 |
| 3,453,689 | 7/1969 | Hume | 264/171 |
| 3,531,368 | 9/1970 | Okamoto et al. | 428/374 |
| 3,540,080 | 11/1970 | Goosens | 425/131.5 |
| 3,559,591 | 6/1972 | Fermi et al. | 425/131 |
| 3,692,423 | 9/1972 | Okamoto et al. | 425/131 |
| 3,729,449 | 4/1973 | Kimura et al. | 528/336 |
| 3,814,561 | 6/1974 | Matsui et al. | 425/131 |
| 3,853,977 | 12/1974 | Matsui et al. | 264/103 |
| 3,865,678 | 2/1975 | Okamoto et al. | 264/174 |
| 3,917,784 | 11/1975 | Nishida | 264/103 |
| 3,966,865 | 6/1976 | Nishida et al. | 264/147 |
| 3,973,905 | 8/1976 | Wilson | 8/130.1 |
| 4,035,441 | 7/1977 | Endo et al. | 264/171 |
| 4,051,287 | 9/1977 | Hayashi et al. | 428/91 |
| 4,073,988 | 2/1978 | Nishida | 428/91 |
| 4,109,038 | 8/1978 | Hayashi et al. | 428/91 |
| 4,165,556 | 8/1979 | Nishida | 28/162 |

FOREIGN PATENT DOCUMENTS

| | | |
|---|---|---|
| 2250496 | 4/1974 | Fed. Rep. of Germany . |
| 43-4540 | 2/1968 | Japan . |
| 50-53503 | 5/1975 | Japan . |
| 51-92310 | 8/1976 | Japan . |
| 733007 | 7/1955 | United Kingdom . |
| 1016861 | 1/1966 | United Kingdom . |
| 1104694 | 2/1968 | United Kingdom . |
| 1167390 | 10/1969 | United Kingdom . |

OTHER PUBLICATIONS

Okamoto–"Ultra-fine Fiber and Its Application", Part I, Japan Textile News, Nov. 1977, pp. 94–97.
Okamoto–"Ultra-fine Fiber and Its Application", Part II, Japan Textile News, Jan. 1978, pp. 77–81.

*Primary Examiner*—Jay H. Woo
*Attorney, Agent, or Firm*—Francis W. Young; Jack H. Hall

[57] ABSTRACT

A multi-component filament consisting of at least two polymer components and having a cross-section in which a matrix component separates several peripherally arranged segments of one or more segment components from each other, and a process for the production of such matrix/segment filaments, wherein the segment component is injected into the matrix component and fed to the spinneret opening in a combined stream with a plurality of segment components separated by the matrix. The multicomponent filament can be drawn to obtain individual microfilaments of less than 1 dtex after splitting, e.g. by false twist texturing.

3 Claims, 20 Drawing Figures

DEVICE FOR THE PRODUCTION OF A MULTICOMPONENT YARN COMPOSED OF AT LEAST TWO SYNTHETIC POLYMER COMPONENTS

This is a division of application Ser. No. 180,786, filed Aug. 25, 1980.

The invention relates to a process for the manufacture of a multicomponent yarn composed of at least two synthetic polymer components, over whose cross section one of the components, the matrix component, separates the other components, hereinafter called the segment component(s), into a plurality of segments which retain their shape and position in the cross section over the length of the yarn, as well as to a device to carry out the process.

BACKGROUND OF THE INVENTION

Numerous processes are known for obtaining yarns from two or more synthetic polymer components, having a cross section in which one of the components separates into at least two segments of the other component, whereby these segments retain their shape and location in the cross section along the yarn.

Okamoto, in an article entitled "Ultra-Fine Fiber and Its Application," *Japan Textile News,* November 1977, pp. 94–97 and December 1977, pp. 77–81, summarized known techniques for making fine-denier fibers and in particular, the ultra-conjugate (converging) fiber spinning method (Integral Fiber's Method). The fiber produced is described as having "islands-in-a-sea."

U.S. Pat. No. 3,531,368 illustrates the details of several types of nozzles referred to in the aforesaid Okamota article and describes a process for the manufacture of a matrix microfilament yarn wherein a great many vary fine microfilaments (segments) of components A are surrounded by a matrix component B and separated from each other by the latter. This type of structure is obtained by first pre-molding bicomponent structures of core-skin or side-by-side structure, collecting a plurality of such pre-formed structures in a funnel-like decreasing chamber opening into a spinning orifice and extruding through the spinning orifice. Both the mutual alignment of the segments over the cross section of the finished yarn and the separation of the segments by the matrix components is random. Special cross section geometries cannot be made reproducibly.

U.S. Pat. No. 3,692,423 also shows yarn cross sections wherein a plurality of segments are separated by a matrix component and further illustrates the "islands-in-a-sea" type fiber similar to that described in U.S. Pat. No. 3,531,368, the improvement comprising limiting the angle, $\theta$, of the funnel-shaped space converging to each spinning orifice, to 75°. U.S. Pat. No. 3,692,423 further relates to the production of sheath-core or side-by-side filaments where the filaments are merged prior to the spinning orifice. With these known devices, the polymer components are supplied in such a manner that one component first flows out from the axial cavity of a feed element into a passage fed peripherally with a second component whereby the two components are combined in sheath-core or side-by-side fashion and pass through a spinning orifice.

U.S. Pat. No. 3,814,561 describes a process for the manufacture of yarns composed of several segments, whereby component B is supplied axially through a passage consisting of at least two slits to form thin layers and component B is laterally supplied through ducts. Patentees indicate, at column 8, lines 5–12, that obtaining yarns with three, five or more segments (with the exception of six segments) is difficult. Moreover, the spinning heads described in this patent are also difficult to make and conversion of the spinning heads from one yarn cross section to another, e.g. from four segments to six segments, is practically impossible.

Finally, in U.S. Pat. No. 3,540,080 a great many yarn cross sections having two or three components, composed of different polymer components, are disclosed. In most cases, a core component will be surrounded by a matrix component. Although it is the objective of many recent developments in the area of multicomponent yarns, these yarns cannot be separated either by mechanical or chemical aftertreatment into a yarn bundle of extremely fine filaments and/or fibers.

DESCRIPTION OF THE INVENTION

An object of the invention is to make available a yarn cross section consisting of at least two; preferably three or more, segments embedded in a separating matrix component, where the segments are not all encased, as seen in the yarn cross section, by a peripheral matrix layer, but substantial parts of which are at the surface of the yarn, to permit easy separation of the segments into microfilaments.

A further object of the invention is to make available a multicomponent filament which can readily subdivided, e.g. mechanically or chemically, into microfilaments of filament deniers much smaller than 1 dtex, resulting in a finest filament yarn of very soft hand and excellent optical characteristics.

Moreover, the matrix layers between the segments should be as small as possible, so that after separation of the segments from each other, a yarn bundle composed of finest filaments of predominantly one polymer is obtained. This may be achieved by having at least seven and/preferably eight or more peripherally aligned segments in the multicomponent filament. Accordingly, as the number of segments increases, the filament denier of the separated segments will be finer, with corresponding softer hand and better optical properties. It is, of course, necessary that the segments undergo practically no change in form and location in the cross section.

Furthermore, an object of the invention is to insure by constructional measures that with one and the same spinning head it is possible to obtain either entirely different yarn bundles consecutively or differently structured yarn cross sections simultaneously from different spinning orifices.

These objects are obtained by the process described herein in which the matrix component is fed to the spinning hole of a spinneret first as a compact core flow and the segment component is injected into the flowing compact core of matrix component as radially or spatially separated partial streams before said matrix component exits from the spinning orifice.

In this manner, it is possible to obtain either multicomponent filaments in which the segments are located at the periphery of the yarn and away from the periphery or multicomponent filaments in which the segments are located only at the periphery. They are firmly fixed geometrically, in other words, have a specific form and position in the cross section of the filaments. One can readily produce in this manner more than six peripheral segments and in addition a plurality of segments located inside the filament. As a result the matrix component can be kept minimal. Accordingly, mechanical and/or chemical separation of the yarn made according to the invention into a yarn bundle of microfilaments can be accomplished e.g. by falsetwist texturing or drawtexturing a yarn composed of several such filaments.

The invention furthermore relates to a device to carry out the process of the invention having a spinneret back plate with transverse boreholes through which feed elements for one polymer component are inserted and a spinneret front plate, also with transverse boreholes coaxially aligned with the back plate boreholes, through which said feed elements are inserted. The boreholes in the back plate are aligned with those of the front plate and open into the spinning orifices. The feed element also has a central borehole coaxial with said boreholes in the front and back plates which acts as a duct to supply the matrix component to the spinning orifice. At least one feed duct supplying one or more distribution chamber with at least one other polymer component is connected with the boreholes and penetrated by the axes of the boreholes. A zone or portion of each of the feed elements, in the vicinity of the distribution chambers may have a smaller diameter than the borehole diameter, forming a recess, giving access from each distribution chamber to the axial hole in the feed element via a plurality of radial passages, preferably three or more, in the wall of the feed element, for feeding the other of the polymer components. The feed elements for the matrix component have an outside diameter corresponding to the diameter of the boreholes so that the feed elements are closely fitted within the boreholes.

The invention is described in further detail in the drawings wherein.

Figure 1:
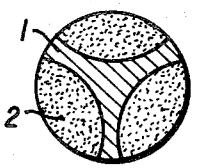
FIG. 1 represents the cross section of a filament of the invention having three separate segments.
Figure 2:
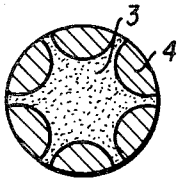
FIG. 2 represents a cross section of a filament of the invention having six segments separated from each other.
Figure 3:
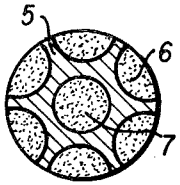
FIG. 3 represents a cross section of a filament according to the invention having six peripherally aligned segments and a core segment.
Figure 4:
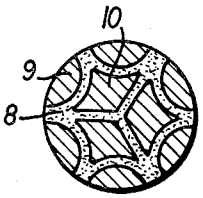
FIG. 4 represents a cross section of a filament according to the invention having six peripheral segments and three core segments.

The filament cross section shown in FIG. 1 consists of three peripheral segments 2, separated by a relatively thin layer of matrix component 1. By contrast, the filament of FIG. 2 has a more pronounced matrix 3 forming the core of the filament surrounded by six peripheral segments. Moreover, the cross section may have seven or more peripheral segments. In the filament of FIG. 3, a matrix 5 is penetrated in the center by a core segment 7, with again six segments at the circumference of the yarn; a preferred cross section has eight outer segments of this type. The cross section according to FIG. 4 shows six peripheral segments 9 and three core segments 10, separated by matrix component 8; other combinations, e.g. four core and eight peripheral segments are feasible. The filament cross section in FIG. 5 consists of eight peripheral segments 12, four core segments 14, an axial core segment 14', and eight outer segments 13 which are fully encased in matrix component 11. Finally, FIG. 6 shows a filament cross section similar to that shown in FIG. 2, whereby segments 4' separated by matrix 3' extend from the edge into the core zone of the cross section. The number of segments may be greater than six, for example, twelve or more.

Figure 7:
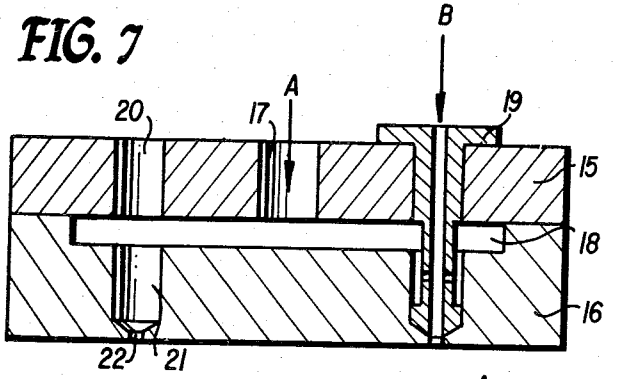
FIG. 7 is a cut-away illustration of the spinning element of a spinning device according to the invention.

FIG. 7 is a schematic of the spinning element of a spinneret, consisting of a spinneret back plate 15 and a spinneret front plate 16. Distribution chamber 18 is located in a zone between the two and accommodates segment component A supplied through feed duct 17. Spinneret back plate 15 has boreholes 20 and spinneret front plate 16 has boreholes 21 aligned with the boreholes 20 to insert feed elements 19 for matrix component B. The delivery tip of each of the boreholes 21 opens into a spinning orifice 22.

Figure 8:
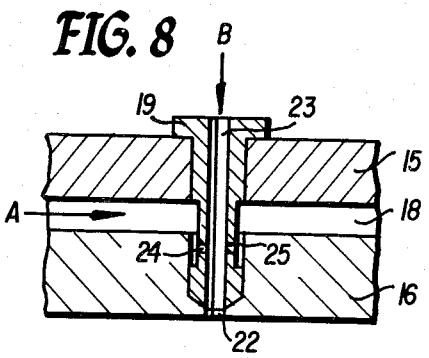
FIG. 8 is a cut-away illustration intended to explain the design features in the feed element zone, essential to the invention.
Figure 9:
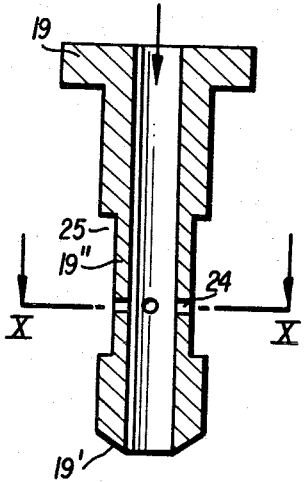
FIG. 9 is an enlarged view of the feed element shown in FIG. 8.

FIGS. 8 and 9 shows respectively, more detailed views of the spinning element and the feed element. A distribution chamber 18 for segment component A is located at or near the interface between spinneret back plate 15 and spinneret front plate 16. A feed element 19 is inserted through spinneret back plate 15 and spinneret front plate 16. Matrix component B flows into axial duct 23 in the form of an initially compact core toward spinning orifice 22. The delivery tip 19' of feed element 19 is fitted tightly into borehole 21 of spinneret front plate 16 against spinning orifice 22. In its simplest form, feed element 19 may be a cylindrical tube inserted both in borehole 20 and borehole 21, which in the area of distribution chamber 18 is provided with at least two diametrically disposed radial passages 24 for segment component A. The feed element 19 may also have a recess 25 in its central section, defined by zone 19, at least part of which is contiguous with the distribution chamber 18.

The zone 19'' has an outside diameter smaller than that of the boreholes 20 and 21. Four radial passages 24 for segment component A are located in the recess 25. Instead of the circumferential recess 25 shown in FIGS. 9 and 10, two or more grooves could be provided.

Figure 9A:
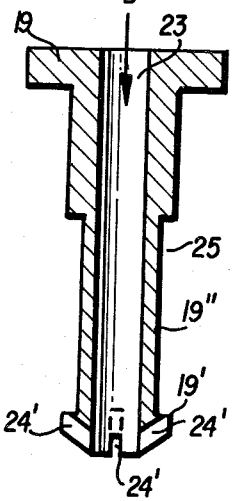
FIG. 9A is a modification of the feed element shown in FIG. 9.

As shown in FIG. 9A, the feed element 19 may be also designed with a recess extending relatively close to its discharge tip and passages, comprising two or more radially aligned grooves 24' at said discharge tip communicating with duct 23, through which segment component A may be injected into the matrix component B shortly before the spinning orifice.

Figure 10:
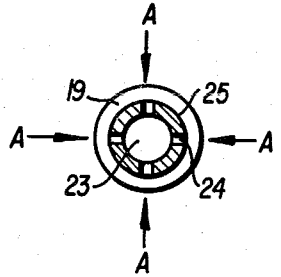
FIG. 10 is a section X—X through the feed element of FIG. 9.

In FIG. 10, segment component A from distribution chamber 18 is injected via recess 25 through radial passages 24 into four spatially separated partial streams into matrix component B before it leaves spinning orifice 22. The result is a filament cross section with four peripheral segments. The size of the segments and the thickness of the matrix layers separating them and hence, the component distribution, is determined by varying the relative quantities and pressures of the components A and B.

Figure 11:
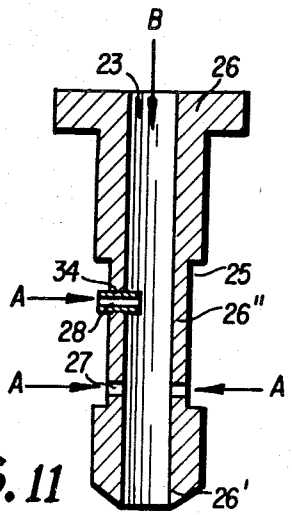
FIG. 11 is another feed element in which the passages for the segment component are aligned in two planes perpendicular to the main axis of the feed element.
Figure 12:
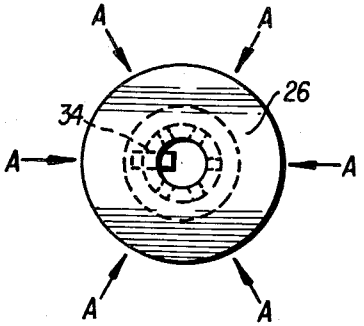
FIG. 12 is a top view of the feed element in FIG. 11.

Feed element 26 shown in FIGS. 11 and 12 differs from feed element 19 in that six passages 27 for segment components A and an additional passage 28, located in a plane further removed from its discharge tip 26', are provided in the recess 25 formed by the reduced diameter zone 26''. Passage 28 is composed of a tube 34, opening immediately adjacent the axis of feed element 26. With this version of feed element 26, it is possible to obtain the yarn cross section shown in FIG. 3. Segment component A flowing via tube 34 into matrix component B forms an axial core segment, whereas the six partial streams, injected through passages 27, form six peripheral segments.

Figure 13:
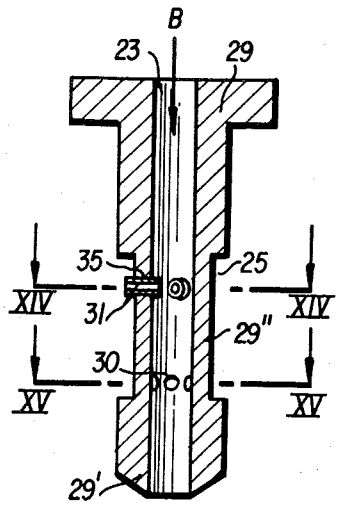
FIG. 13 is another feed element with passages provided in two planes perpendicular to the main axis of the feed elements.
Figure 14:
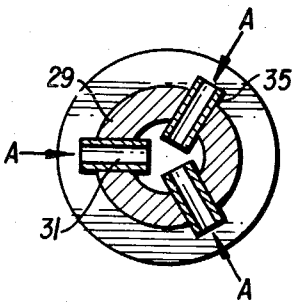
FIG. 14 is a section XIV—XIV through the feed elements shown in FIGS. 13 and 16.
Figure 15:
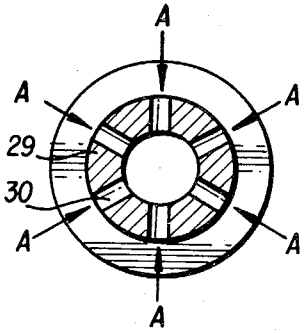
FIG. 15 is a section XV—XV through the feed elements in FIGS. 13 and 16.
Figure 17:
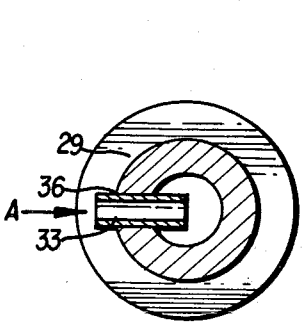
FIG. 17 is a section XVII—XVII through the feed element of FIG. 16.

Another version of a feed element 29 is shown in FIGS. 13, 14, and 15. Passages 30 and 31 are located in the recess 25 formed in the zone of the smaller diameter portion 29'' of feed element 20. Passage 31 is in a plane perpendicular to the axis of duct 23 and further removed from the discharge tip 29' than that of passage 30. Each passage 31, formed by a tube 35, extend equally far into duct 23. With this version one obtains the filament cross section shown in FIG. 4, consisting of three core segments and six peripheral segments.

Figure 18:
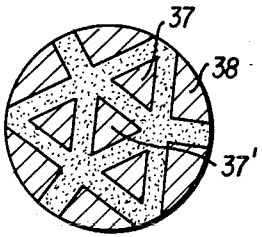
FIG. 18 is a cross section of a filament of the invention obtained from the feed element shown in FIG. 16.
Figure 16:
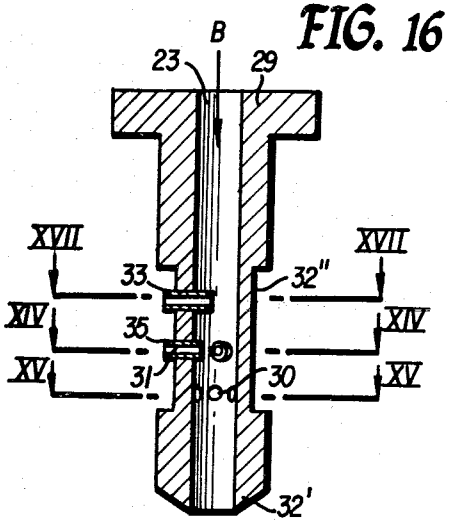
FIG. 16 is a feed element with passages provided in three planes perpendicular to the main axis of the feed element.

FIG. 16 illustrates a feed element 29 with passages 30, 31, 33 located in three planes. Six passages 30 are provided in the plane nearest discharge tip 32'. Three tubes 35 extend for some distance into duct 23 in an intermediate plane. A tube 36 extends nearly to the axis of feed element 32 in a plane farthest from the discharge end 32'. Filament cross sections exhibiting a total of four core segments 37, 37' and six peripheral segments 38 can be obtained with this version as illustrated in FIG. 18.

Figure 19:
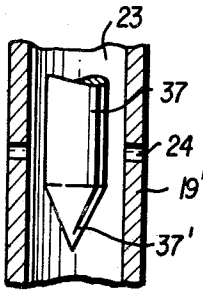
FIG. 19 is a cut away illustration of a feed element having a coaxial pin.

In the cut away illustration in FIG. 19 of another version of feed element 19 (cf. FIGS. 9 and 10), a pin 39 is aligned coaxially in duct 23, which pin ends adjacent to passages 24, preferably slightly below same, e.g. in a point 39'. This version yields filament cross sections as shown in FIG. 6, whereby the segments 4', separated by matrix 3', are quite thin and fragile and extend into the core zone of the cross section.

The process and device of the invention offer a great many variation possibilities in terms of filaments and products made therefrom.

For instance, instead of one segment component A, use can be made of different segment components. Each segment component can be supplied by distribution chambers sealed off from one another which may be located in different planes.

As a rule, only one component will be selected as matrix component B. However, two matrix components may also be used, e.g. fed in a side-by-side arrangement or as a polymer mixture to axial duct 23 of the feed elements.

Practically all fiber forming polymers, namely polyester, polyamides, polyolefins, polycarbonates and the like can be used both for the matrix and the segments. If the multicomponent structure is only aimed at optimizing filament properties, without aftertreatment-induced fibrillation (splitting up) of the components, use is made of components having a favorable mutual adhesion (compatibility), e.g. polyethylene terephthalate as matrix component and polyethylene terephthalate reacted with a gas forming agent as segment component. The resulting is then composed of blown or porous segments held together by a solid matrix. Conversely, the segments may be solid and the matrix porous.

If subsequent subdivision into very fine filaments and fibers is desired, the components should have only slight mutual compatibility, e.g. a polyester, especially polyethylene terephthalate, as segment component and a polyamide, especially polycaprolactam, as matrix component. The filaments are readily divided by subsequent mechanical treatment. The proportion of matrix to segment component may vary within wide limits. Typical weight ratios of matrix to segment components for standard multicomponent yarns are 30:70 to 70:30, preferably 50:50. If microfilaments obtained by splitting up the multicomponent filaments are desired, the weight ratios (i.e. matrix:segment) are between 5:95 and 40:60 and preferably, between 5:95 and 25:75. The same weight ratios are also used when one of the components is subsequently dissolved. If the segment component is dissolved, short profile filaments having a sharp profile are obtained. If the matrix component is dissolved, a yarn bundle of finest individual filament denier from a single polymer can be obtained. Such filament yarns have a very soft hand and excellent optical properties.

The denier of the multicomponent filaments after drawing should preferably be between 2.4 to 11.1 dtex, whereby the segments will preferably have an individual denier of 0.2 to 0.5 dtex.

Interesting crimp effects are obtained and the separation of the multicomponent filament into a filament bundle is facilitated when the segments are alternately composed of polyethylene terephthalate having a differential shrinkage, hence e.g. a different degree of polymerization.

Instead of a circular yarn cross section any conventional profile can be produced, for example polygonal (e.g. hexagonal) or multi-lobed cross sections. To this end, the axial ducts of the feed elements and/or the spinning orifices may be profiled.

Figure 5:
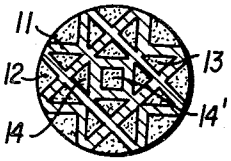
FIG. 5 represents a cross section of a filament of the invention having eight peripheral segments and thirteen segments fully encased in the matrix component.
Figure 6:
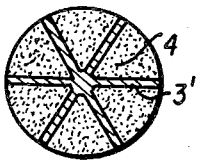
FIG. 6 represents a cross section of a filament according to the invention having six separate segments extending into the core zone of the cross section.

A filament bundle of extremely fine, nearly trilobal filaments of very similar cross section can be obtained from a multicomponent filament, such as shown in FIG. 5, characterized by eight peripheral and thirteen core segments.

By varying the design parameters of the feed element (e.g. number of passages, their location in different planes, use of tubes extending different lengths into the axial ducts) the device of the invention permits the production of a great many filament cross sections more readily and with greater precision than previously known devices. Moreover, it also permits the production of entirely new cross section arrangements. Furthermore, the feed elements of a spinneret may also be exchanged for others, permitting rapid conversion to other cross section types. Also, two or more different individual feed elements can be inserted into a spinneret to obtain interesting blend yarns, e.g. filaments of varying deniers.

We claim:

1. Spinning apparatus for making a multi-component filament comprising a spinneret back plate having first transverse boreholes therein, a spinneret front plate having second transverse boreholes aligned with said first transverse boreholes in said back plate, a spinning orifice aligned with each of said second boreholes and adjacent thereto; a feed element for a matrix polymer component extending through each of said first and second boreholes, said feed elements each having a central duct, coaxial with said first and second boreholes, to supply said matrix polymer component to said spinning orifices, at least one feed channel and at least one distribution chamber for at least one other polymer component, each of said distribution chambers being connected to said central duct by a plurality of radial passages through the wall of said feed element, said feed elements having a zone intermediate the ends of said feed elements having a smaller diameter than the diameter of said first and second boreholes and having in said zone said radial passages for the said other polymer component and said radial passages lying in at least two planes perpendicular to the direction of the axis of said central duct.

2. The apparatus of claim 1 wherein at least one of said passages consists of small tube through said feed elements having an outlet in the interior of said axial duct and spaced from the wall thereof.

3. The apparatus of claim 2, wherein said outlets in the interior of said axial duct are at different distances from the axis of said axial hole.

* * * * *